US007023385B2

(12) United States Patent
Harihara

(10) Patent No.: US 7,023,385 B2
(45) Date of Patent: Apr. 4, 2006

(54) CHIP ANTENNA, CHIP ANTENNA UNIT AND WIRELESS COMMUNICATION DEVICE USING THE SAME

(75) Inventor: Yasumasa Harihara, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/722,433

(22) Filed: Nov. 28, 2003

(65) Prior Publication Data

US 2004/0119647 A1 Jun. 24, 2004

(30) Foreign Application Priority Data

Nov. 29, 2002 (JP) ..... 2002-347735
Nov. 29, 2002 (JP) ..... 2002-347736

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 795, 895

See application file for complete search history.

(56) References Cited

U.S. PATENT DOCUMENTS 5,748,149 A * 5/1998 Kawahata ..... 343/700 MS
6,064,351 A * 5/2000 Mandai et al. ..... 343/873
6,583,769 B1 * 6/2003 Shiroki et al. ..... 343/895
6,600,449 B1 * 7/2003 Onaka et al. ..... 343/700 MS
6,657,593 B1 * 12/2003 Nagumo et al. ..... 343/700 MS
6,680,700 B1 * 1/2004 Hilgers ..... 343/700 MS
6,683,573 B1 * 1/2004 Park ..... 343/700 MS
6,778,141 B1 * 8/2004 Yeh ..... 343/700 MS

FOREIGN PATENT DOCUMENTS

| | | |
|---|---|---|
| JP | 09-55618 | 2/1999 |
| JP | 11-31913 | 2/1999 |
| JP | 2001-177330 | 6/2001 |
| JP | 2002-100915 | 4/2002 |
| JP | 2002-100916 | 4/2002 |
| JP | 2002-111344 | 4/2002 |

OTHER PUBLICATIONS

International Search Report dated Mar. 30, 2004.

* cited by examiner

*Primary Examiner*—Tan Ho
(74) *Attorney, Agent, or Firm*—McGinn IP Law Group, PLLC

(57) ABSTRACT

A chip antenna has pattern antennas A1, A2' which are formed on a plurality of layers of a base member of a stacked structure and of which at least parts of their patterns are not overlapping with each other in the stacked direction, and a feeding terminal 12 which is formed on a surface of the base member and which is connected to the pattern antennas A1, A2'. By deleting an overlap with each other in the stacked direction between their patterns of pattern antennas A1, A2', one pattern antenna can be adjusted to have an optimized resonant frequency without influencing frequency characteristics of another pattern antenna. The pattern antenna A2' has a first area of a rectangular shape and a second area elongating continuously from the first area. Upon adjusting a length of an arm in the direction that the second area elongates in the first area and a length of the second area, a desirable resonant waveform can be obtained

18 Claims, 7 Drawing Sheets

CHIP ANTENNA, CHIP ANTENNA UNIT AND WIRELESS COMMUNICATION DEVICE USING THE SAME

BACKGROUND OF THE INVENTION

The present invention relates to a chip antenna for use, as an included antenna, and the like, in a portable telephone or a mobile terminal which is a wireless communication device, and a chip antenna unit in which the chip antenna is mounted in a mounting substrate.

Conventionally, a compact chip antenna for diversity reception, which is capable of being used in a plurality of frequency bands, such as 800 MHz band and 1500 MHz band, has been used in a mobile terminal, such as a portable telephone, or the like. An example of such a compact chip antenna is exemplified in, for example, Japanese laid open Official Gazette No. Hei 11-31913, namely, No. 1999/31913. In the Official Gazette, disclosed is a technique that the chip antenna has a conductor and a trap circuit inserted in an intermediate portion of the conductor and that two resonations, namely, a resonance by a whole of the chip antenna and another resonance by a portion of the conductor up to the trap circuit, are obtained.

Further, in Japanese laid open Official Gazette No. 2002/111344, disclosed is a technique that two resonances are obtained, respectively by a chip antenna and by a pattern antenna composed in a substrate.

As mentioned above, the two resonances can be obtained in the technique disclosed in the Official Gazette No. Hei 11-31913. However, not only a structure of the antenna becomes complicated but also antenna efficiency is deteriorated by resistance of the trap circuit.

Moreover, the antenna is fabricated on the substrate by a conductive path pattern in the technique disclosed in the Official Gazette No. 2002/111344. As a result, an antenna portion thereof becomes very large in size, in spite of requirement of fabricating the antenna in a smaller size.

Besides, what is called, a wide-band chip antenna is obtain d, when the respective resonant frequency bands of the two resonances in the chip antenna are rendered to be close to each other. Even if such a wide-band chip antenna is fabricated by the techniques disclosed in the above-mentioned Official Gazettes, problems similar to the above are inevitably caused to occur.

Under these circumstances, it is strongly desired to develop a chip antenna capable of obtaining resonances in a plurality of frequency bands or a broad frequency band in spite of a plain structure of the chip antenna.

In the interim, when a plurality of pattern antennas are located to be stacked on each other by making an antenna element have a stacked structure, a chip antenna having a plurality of resonances can be fabricated small in size with a plain structure thereof.

However, when frequency characteristics of one antenna are adjusted by altering a shape of the pattern antenna, frequency characteristics of the other antenna are also varied responsively. It therefore becomes difficult that the chip antenna is rendered to have an optimized resonant frequency.

On the other hand, when a chip antenna is mounted on a mounting substrate, it is sometimes caused to occur that frequency characteristics of the chip antenna are fairly varied under the influence of a path pattern, or the like.

In this case, since the frequency characteristics cannot be adjusted finely in the conventional chip antenna, the chip antenna itself must be replaced with another one Accordingly, it is necessary to prepare many kinds of antennas having frequency characteristics fairly different from each other, respectively. This makes productivity of the chip antenna units remarkably deteriorated.

Accordingly, it is an object of the present invention to provide a chip antenna capable of obtaining resonances in a plurality of frequency bands or a broad frequency band in spite of a plain structure of the chip antenna.

It is another object of the present invention to provide a chip antenna capable of rendering a predetermined pattern antenna to have an optimized resonant frequency without influencing frequency characteristics of the other pattern antenna.

It is yet another object of the present invention to provide a chip antenna capable of readily adjusting frequency characteristics thereof.

SUMMARY OF THE INVENTION

According to an aspect of the present invention, there is provided a chip antenna comprising: a base member which is composed of dielectric or magnetic material and which has a stacked structure including a plurality of layers, a plurality of pattern antennas which are formed on a plurality of layers and which have predetermined patterns, respectively, and of which at least parts of the predetermined patterns are not overlapping with each other in the stacked direction of a plurality of layers; and a feeding terminal which is formed on a surface of the base member and which is connected to a plurality of pattern antennas.

Thus, the patterns are not overlapping with each other in the stacked direction. It thereby becomes possible that a predetermined pattern antenna can be determined to have an optimized resonant frequency without influencing frequency characteristics of another pattern antenna.

According to another aspect of the present inventions there is provided a chip antenna unit having predetermined frequency characteristics, comprising: a mounting substrate; a base member which is mounted on the mounting substrate and which is composed of dielectric or magnetic material; a pattern antenna which is formed on the base member; a feeding terminal which is formed on a surface of the base member and which is connected to the pattern antenna; a fixed terminal which is formed on a surface of the base member and which is connected to the pattern antenna; a fixing portion which is composed of a conductor and which is formed on the mounting substrate and which is connected to the fixed terminal and thereby fixes the base member on the mounting substrate; and the predetermined frequency characteristics being adjusted by changing an area of the fixing portion.

Accordingly, a resonant frequency of the chip antenna can be finely tuned by adjusting the area of the fixing portion. It therefore becomes possible that the frequency characteristics of the chip antenna are readily adjusted.

According to yet another aspect of the present invention, there is provided a chip antenna comprising: a base member which is composed of dielectric or magnetic material; a pattern antenna which is formed on the base member and which includes a first area having a rectangular shape and a second area elongating continuously from the first area; and a feeding terminal which is formed on a surface of the base member and which is connected to the pattern antenna.

Accordingly, upon adjusting a length of an arm in the direction that the second area elongates in the first area and a length of the second area, it becomes possible to obtain resonances in a plurality of frequency bands or a broad frequency band in spite of a plain structure of the chip antenna.

DETAILED DESCRIPTION OF THE PREFERRED EMBODIMENTS

Figure 1:
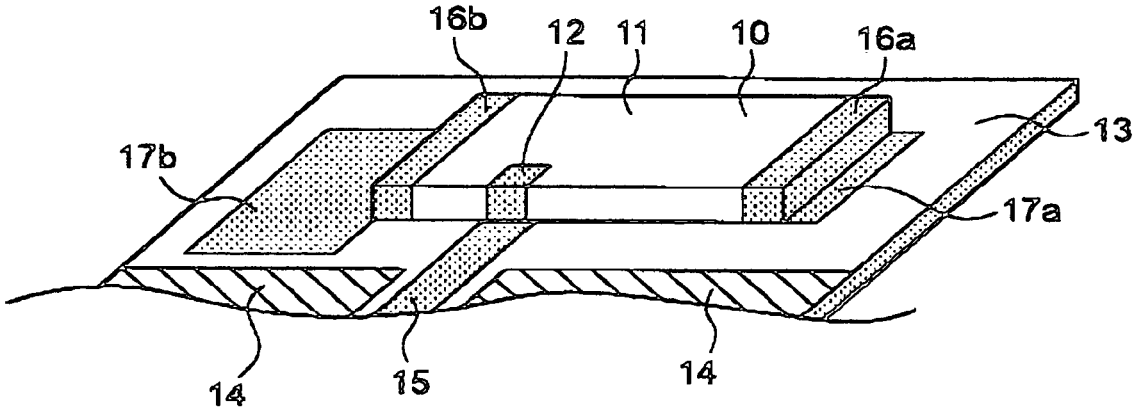
FIG. 1 is a perspective view for schematically showing a chip antenna unit according to a first embodiment of the present invention.

Now, referring to the drawings, embodiments of the present invention will be described more concretely. Herein, the same members are designated by the same reference numerals in the attached drawings. Further, overlapped description will be omitted. Besides, the embodiments of the invention are particularly useful embodiments for carrying out the present invention. The present invention is therefore not restricted to the embodiments.

At first, referring to FIGS. 1 through 4, description is made about a first embodiment of the present invention.

Figure 2:
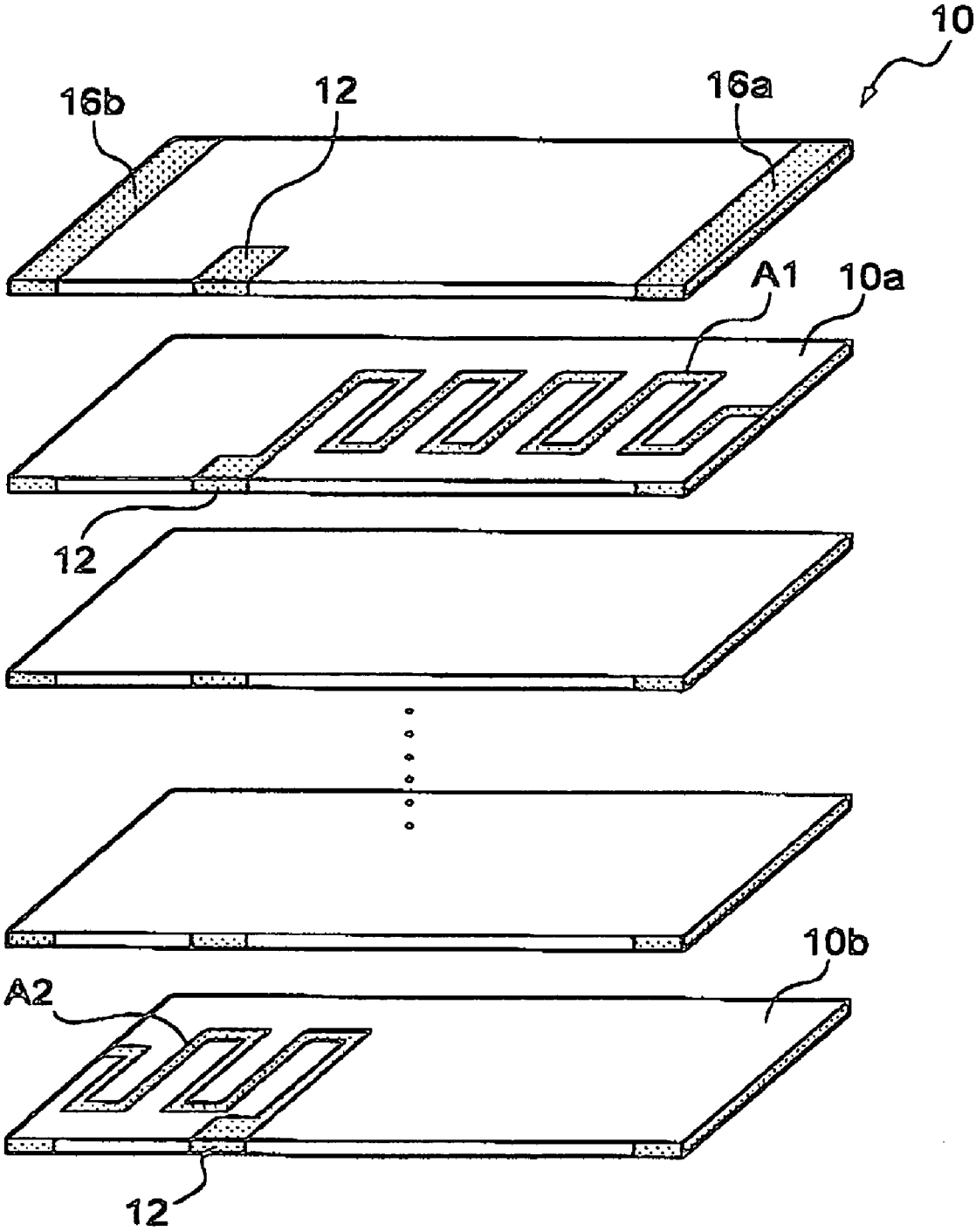
FIG. 2 is an exploded perspective view for schematically showing a chip antenna in the chip antenna unit illustrated in FIG. 1.
Figure 3:
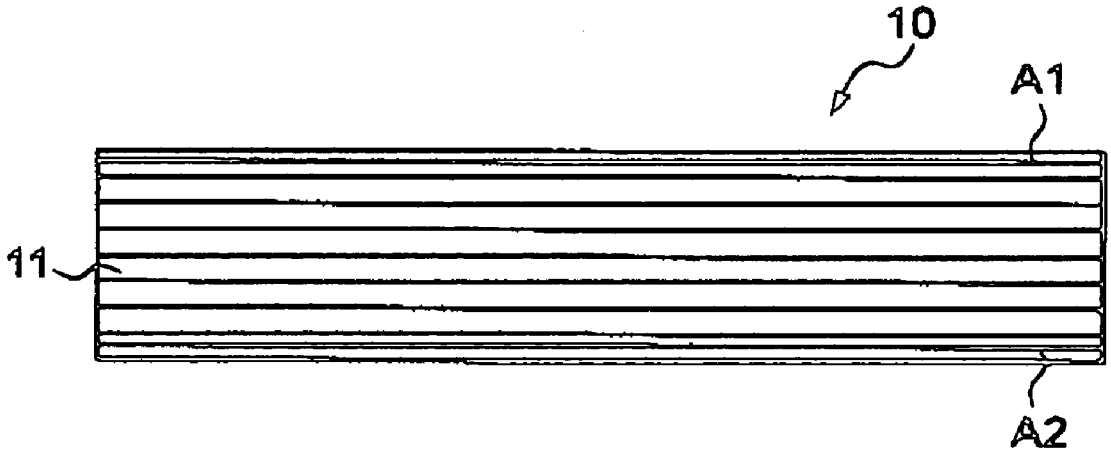
FIG. 3 is a sectional view for schematically showing a chip antenna in the chip antenna unit illustrated in FIG. 1.
Figure 4:
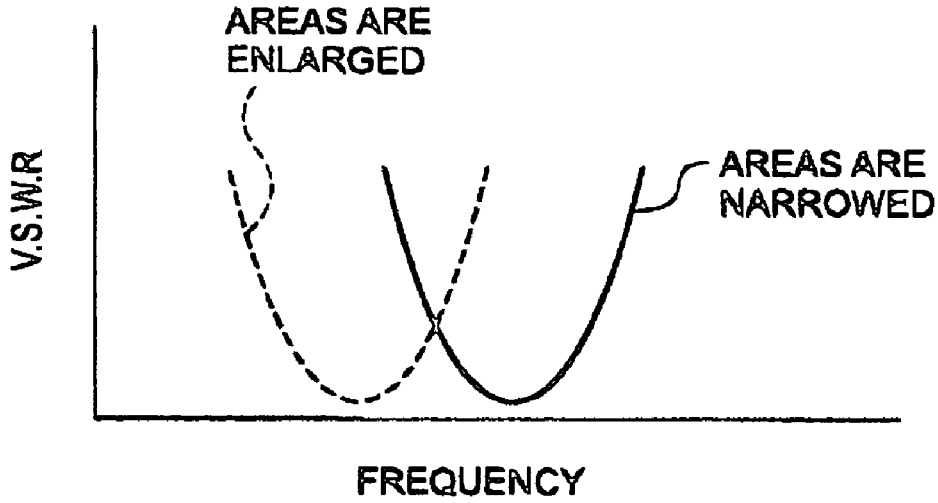
FIG. 4 is a graph for showing frequency characteristics of VSWR (Voltage/Standing Wave Ratio), dependent on broadness of the area of the fixing portion in the chip antenna unit illustrated in FIG. 1.

FIG. 1 is a perspective view for schematically showing a chip antenna unit according to the first embodiment of the present invention. FIG. 2 is an exploded prospective view for schematically showing a chip antenna in the chip antenna unit illustrated in FIG. 1. FIG. 3 is a sectional view for schematically showing the chip antenna illustrated in FIG. 2. FIG. 4 is a graph for showing frequency characteristics of VSWR, depend at on broadness of an area of a fixing portion in the chip antenna unit illustrated in FIG. 1.

As illustrated in FIGS. 1 through 3, a chip antenna 10 according to this embodiment has a rectangular base member 11 which is composed of a stacked structure formed by a ceramic dielectric material for high frequency of which, for example, specific inductive capacity or is approximately equal to 10. Alternatively, the base member 11 may be composed of a magnetic material.

Pattern antennas are formed on a plurality of layers of the base member 11. As illustrated in FIG. 2, a pattern antenna A1 having a first pattern of a meander shape is formed on a first pattern layer 10*a* while a pattern antenna A2 having a second pattern of another meander shape different from that of the first pattern is formed on a second pattern layer 10*b*. Besides, the first and the second pattern antennas A1, A2 are formed to have the first and the second patterns of meander shapes, respectively, in this embodiment. However, the first and the second pattern antennas A1, A2 may be formed to have various patterns of, for example, a circular shape, a rectangular shape, a three-dimensional helical shape over a plurality of layers, and the like. Further, even when the first and the second pattern antennas A1, A2 are formed to have the first and the second patterns of meander shapes, as mentioned above, the first and the second pattern antennas A1, A2 may be formed to have patterns composed of a plurality of layers for obtaining reactance capacity.

As illustrated in FIG. 1, a feeding terminal 12 is formed from a bottom surface of the base member 11 to an upper surface thereof through one side surface thereof. Further, fixed terminals 16*a*, 16*b* are formed on two side surfaces opposite to each other and adjacent surfaces around the two side surfaces. Thus, the feeding terminal 12, the fixed terminal 16*a* and the fixed terminal 16*b* are formed on the surfaces f the base member 11, respectively. As depicted in detail in FIG. 2, the feeding terminal 12 is connected to one end of each of the first and the second pattern antennas A1, A2, the fixed terminal 16*a* is connected to another end of the first pattern antenna A1, and the fixed terminal 16*b* is connected to another end of the second pattern antenna A2, respectively.

As illustrated in FIG. 1, the chip antenna 10 is mounted on a mounting substrate 13. Accordingly, a chip antenna unit according to this embodiment of the present invention is constituted by the chip antenna 10 and the mounting substrate 13. A ground electrode 14 is formed on the mounting substrate 13. Further, a feeding path 15 which supplies signals from a signal source (not shown) to the feeding terminal 12 by keeping matching with an impedance of the circuit, for example, 50 Ω is also formed on the mounting substrate 13. Moreover, fixing portions 17*a*, 17*b* which are composed of conductors and connected to the fixed terminals 16*a*, 16*b* and which thereby fix the base member 11 on the mounting substrate 13 are also formed on the mounting substrate 13.

Besides, the fixed terminals 16*a*, 16*b* and the fixing portions 17*a*, 17*b* are formed at two positions, respectively, in this embodiment. However, the fixed terminals 16*a*, 16*b* and the fixing portions 17*a*, 17*b* may be formed at only one position, respectively.

In the interim, the first and the second pattern antennas A1, A2, the feeding terminal 12, the ground electrode 14, the feeding path 15, the fixed terminals 16*a*, 16*b*, and the Sing portions 17*a*, 17*b* are formed by patterning metal conductor layers of copper, silver, and the like. Concretely, those are formed, for example, by a method that a metal paste of silver, and the like is subjected to a pattern printing and is thereby burned on, a method that a metal pattern layer is formed by plating, and a method that a thin metal film is subjected to the patterning by etching.

Herein, as illustrated in FIG. 2, the first pattern antenna A1 having the first pattern and the second pattern antenna A2 having the second pattern are not overlapping with each other in the stacked direction of a plurality of layers, namely the first pattern layer 10*a*, the second pattern layer 10*b*, and so on.

With the structure being illustrated, in the chip antenna 10 of this embodiment, a first resonant frequency can be obtained by the first pattern antenna A1. On the other hand, a second resonant frequency which is different from the first resonant frequency can be obtained by the second pattern antenna Aid. Consequently, the first pattern antenna A1 and the second pattern antenna A2 can be prevented from being overlapping with each other in the stacked direction.

Thus, even though frequency characteristics of one pattern antenna (for example, the first pattern antenna A1) are adjusted by changing a shape thereof, little influence is given to frequency characteristics of another pattern antenna (for example, the second pattern antenna A2). As a result, a predetermined pattern antenna (for example, the first pattern antenna A1) can be adjusted to have an optimized resonant frequency without influencing the frequency characteristics of another pattern antenna (for example, the second pattern antenna A2).

Accordingly, since resonant frequencies of respective pattern antennas are independent from each other, an antenna can be more readily designed.

Herein, in a part and around the part of the first and the second pattern antennas A1 and A2 by which the feeding terminal 12 is coupled thereto, the first and the second pattern antennas A1 and A2 inevitably come to be overlapping with the structures thereof. Under the circumstances, although the words "not overlapping" are used in the specification and the claims of this application, it is enough that the other portions except for these parts are not overlapping with each other.

Besides, parts f the patterns may be overlapping with each other. However, the larger a portion of overlapping in the stack d direction becomes, the larger a change of frequency characteristics of the another pattern antenna becomes at the time of adjusting the resonant frequency of one pattern antenna. It is therefore desirable that the other portions except for the above-mentioned inevitable parts are not overlapping with each other.

Further, although only the first and the second pattern antennas A1 and A2 which are not overlapping with each other are exemplified in this embodiment, the other pattern antennas can be formed in addition thereto. In this case, all the pattern antennas may be not overlapping with each other. Alternatively, a part of the all pattern antennas may be overlapping with each other. In other words, it is enough that at least a part of the all pattern antennas are not overlapping with each other in the stacked direction.

Further, it is enough that at least two pattern antennas, namely, a plurality of pattern antennas are formed in the present invention.

In the interim, when the chip antenna 10 is mounted on the mounting substrate 13, frequency characteristics of the chip antenna 10 are sometimes fairly varied under the influence of a pattern of the feeding path 15 or the other electronic components.

In such a case, it is possible that the frequency characteristics of the chip antenna 10 are adjusted by changing areas of the fixing portions 17*a*, 17*b*, namely, by enlarging the fixing portions 17*a*, 17*b* or deleting a part thereof at the time of mounting the chip antenna 10.

Subsequently, as illustrated in FIG. 4, the resonant frequency of the chip antenna 10 moves to the lower frequency side, when the areas of the fixing portions 17*a*, 17*b* are enlarged. On the contrary, the resonant frequency of the chip antenna 10 moves to the higher frequency side, when the areas of the fixing portions 17*a*, 17*b* are narrowed. Accordingly, in a case that the resonant frequency of the chip antenna 10 is lower than an expected value n a condition that the chip antenna 10 is mounted on the mounting substrate 13, the resonant frequency thereof can be moved to the higher frequency side by deleting the fixing portions 17*a*, 17*b*. On the contrary, in a case that the resonant frequency of the chip antenna 10 is higher than the expected value on the mounted condition, the resonant frequency thereof can be moved to the lower frequency side by enlarging the areas of the fixing portions 17*a*, 17*b*.

Thus, the resonant frequency of the chip antenna 10 can be finely tuned by adjusting the areas of the fixing portions 17*a*, 17*b*. It therefore becomes possible that the frequency characteristics of the chip antenna 10 are readily adjusted. As a result, it is not necessary to replace the antenna itself, even though the frequency characteristics of the chip antenna 10 are varied by being mounted on the mounting substrate 13.

Further, since the antenna itself thus does not need to be replaced, it is enough to prepare merely one kind of antenna having predetermined frequency characteristics as the chip antenna 10. Accordingly, it is not necessary to prepare many kinds of antennas having frequency characteristics fairly different from each other, respectively, Productivity of the chip antenna units is thereby improved.

In this embodiment, two structures are employed. Namely, not only a structure that the patterns of a plurality of pattern antennas are prevented from being overlapping each other in the stacked direction but also a structure that the resonant frequency of the chip antenna is finely tuned by adjusting the areas of the Sing portions 17*a*, 17*b* are employed in this embodiment. However, any one of the two structures can be employed independently.

Further, when the structure that the areas of the fixing portions 17*a*, 17*b* are adjusted is employed, the pattern antenna may be formed on any surface of the base member or inside the base member. Alternatively, the pattern antenna may be formed both on any surface of the base member and inside the base member. Accordingly, only one pattern antenna r a plurality of pattern antennas may b used in the structure. It is therefore not required that the base member has a stacked structure.

As will be clearly understood from the above description, the patterns are not overlapping with each other in the stacked direction, a predetermined pattern antenna can thereby be adjusted to have an optimized resonant frequency without influencing the frequency characteristics of the other pattern antennas.

In addition, the resonant frequency of the chip antenna can be finely tuned by adjusting the areas of the fixing portions. It therefore becomes possible that the frequency characteristics of the chip antenna are readily adjusted.

Next, referring to FIGS. 5 through 11, description will proceed to a second embodiment of the present invention.

Figure 5:
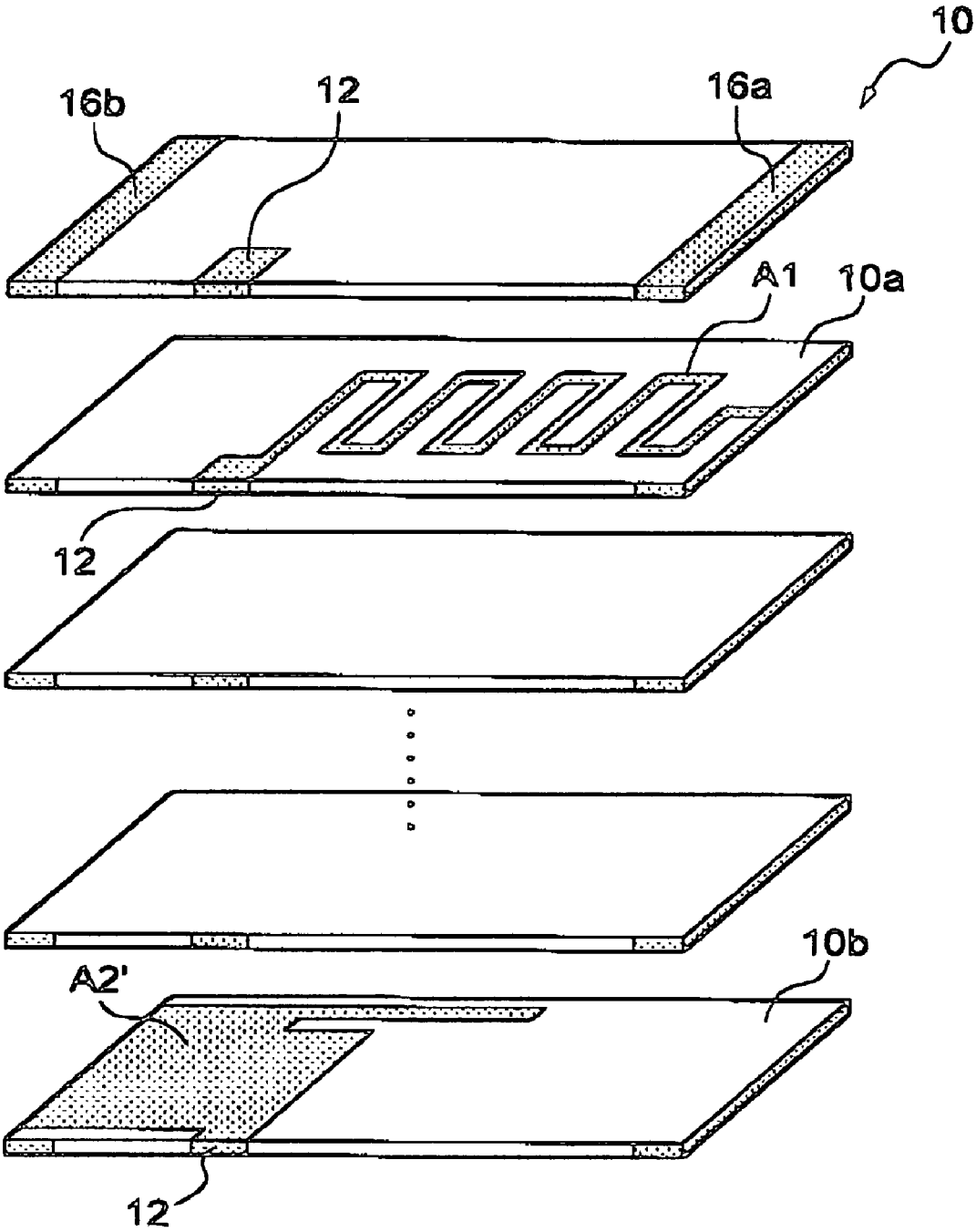
FIG. 5 is an exploded perspective view for schematically showing a chip antenna in the chip antenna unit according to a second embodiment of the present invention.
Figure 6:
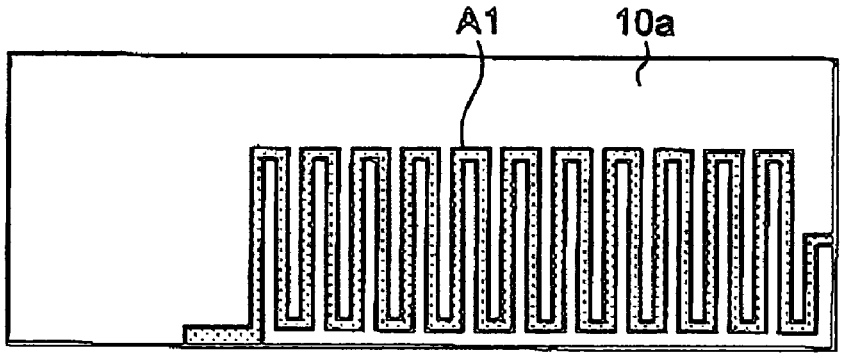
FIG. 6 is a plan view for schematically showing a pattern antenna of the first pattern formed in the chip antenna illustrated in FIG. 5.
Figure 7:
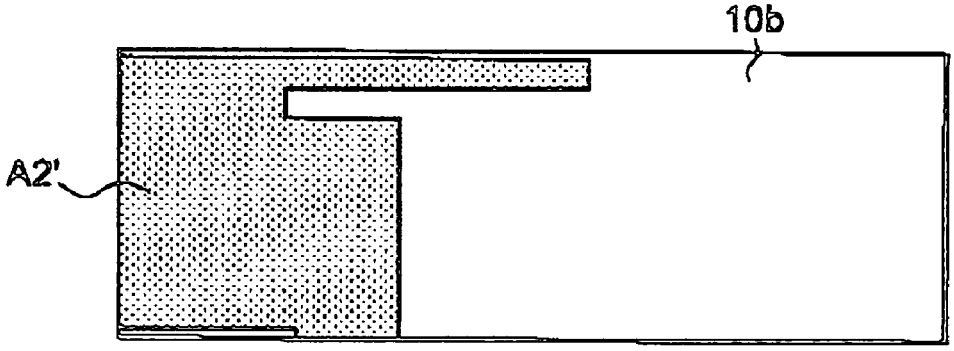
FIG. 7 is a plan view for schematically showing a pattern antenna of the second pattern formed in the chip antenna illustrated in FIG. 5.
Figure 8:
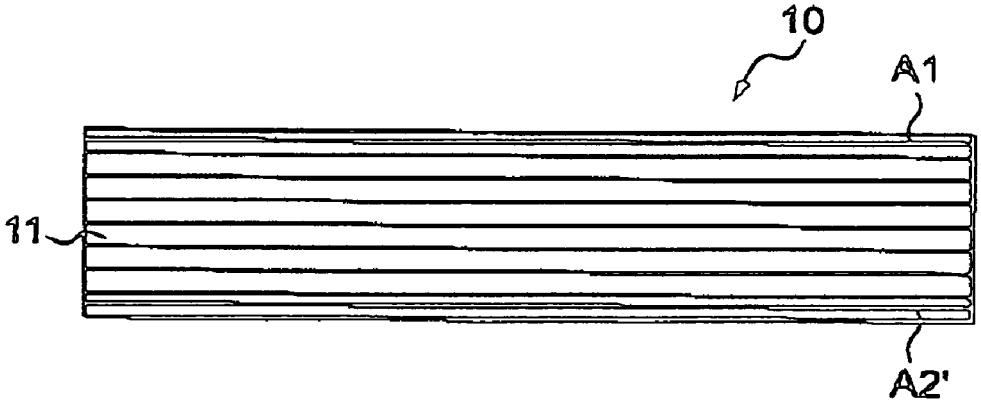
FIG. 8 is a sectional view for schematically showing a chip antenna illustrated in FIG. 5.
Figure 9:
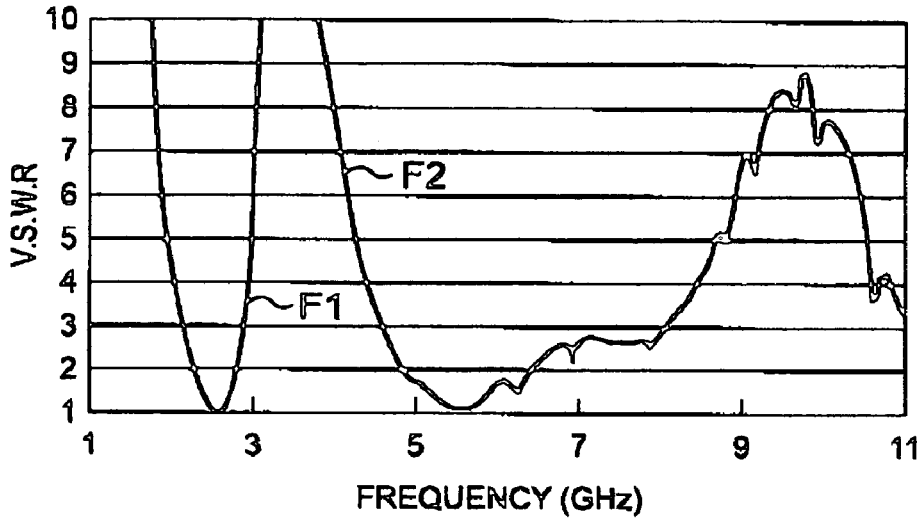
FIG. 9 is a graph for showing frequency characteristics of VSWR between 1 GHz and 11 GHz in the chip antenna unit according to the second embodiment of the present invention.
Figure 10:
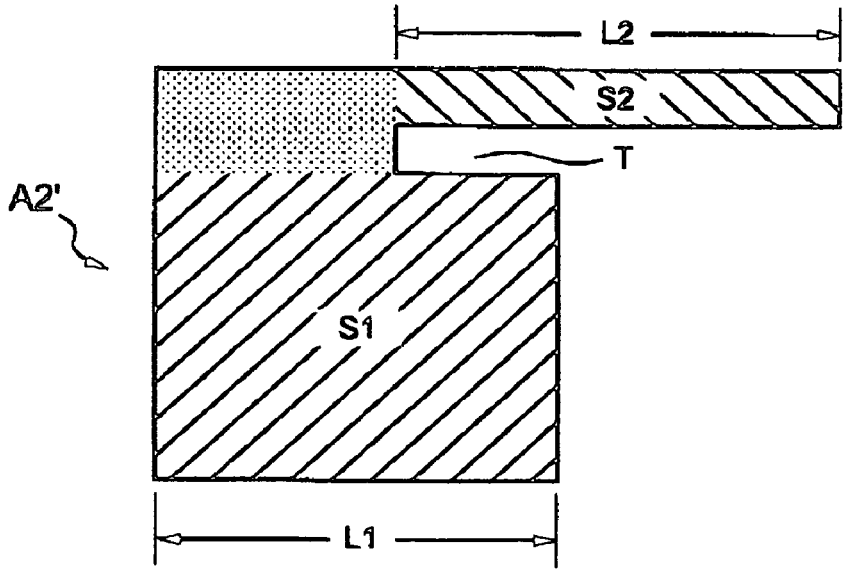
FIG. 10 is a conceptual view for explaining a pattern antenna of the second pattern in the chip antenna illustrated in FIG. 5.
Figure 11:
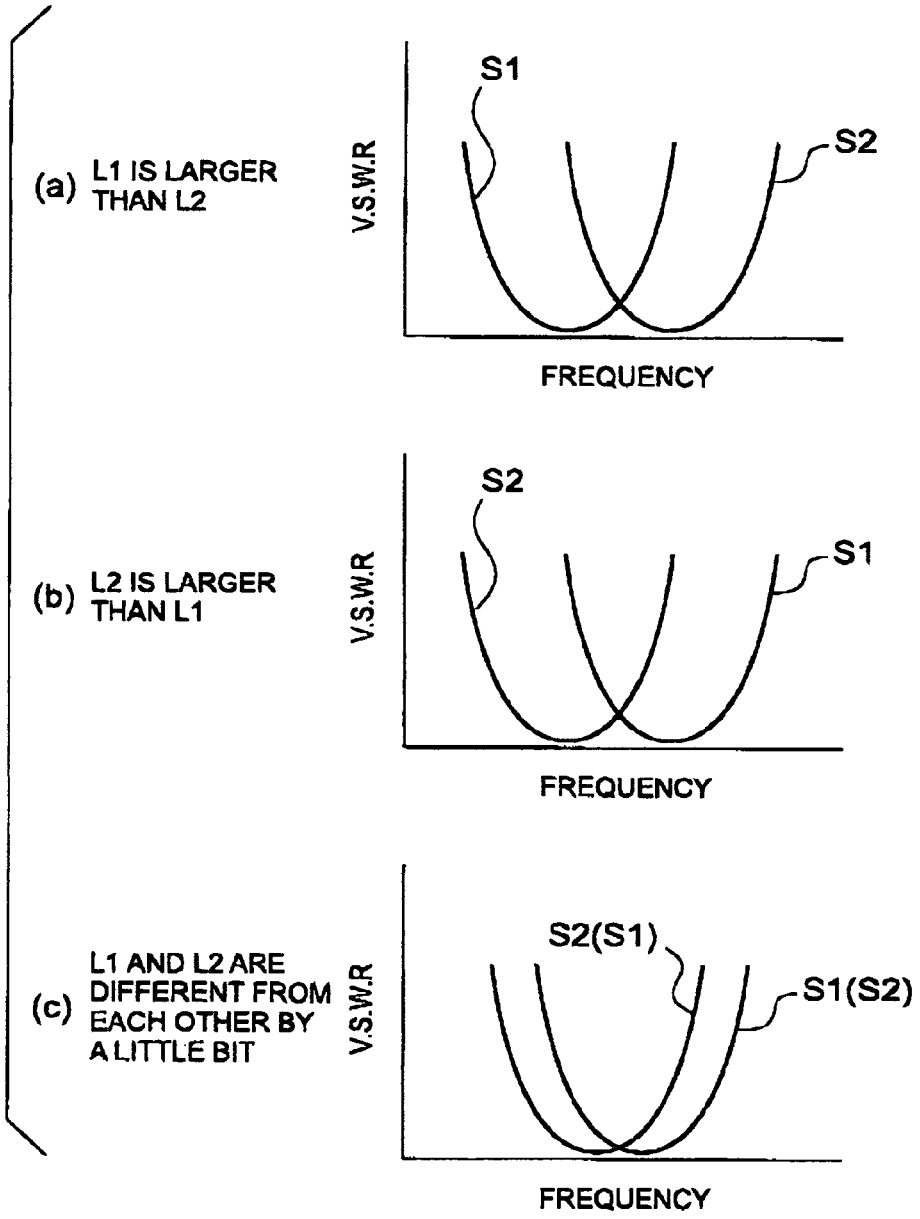
FIG. 11 is a graph for showing frequency characteristics of VSWR in the pattern antenna of the second pattern in the chip antenna illustrated in FIG. 5, when length of predetermined portions illustrated in FIG. 10 are varied.

FIG. 5 is an exploded perspective view for showing a chip antenna in a chip antenna unit according to the second embodiment of the present invention. FIG. 6 is a plan view for showing a pattern antenna of a first pattern formed in the chip antenna illustrated in FIG. 5. FIG. 7 is a plan view for showing a pattern antenna of a second pattern formed in the chip antenna illustrated in FIG. 5. FIG. 8 is a sectional view for showing the chip antenna illustrated in FIG. 5. FIG. 9 is a graph for showing frequency characteristics of VSWR between 1 GHz and 11 GHz in the chip antenna unit according to the second embodiment of the present invention. FIG. 10 is a conceptual view for explaining the pattern antenna of the second pattern in the chip antenna illustrated in FIG. 5. FIG. 11 is a graph for showing frequency characteristics of VSWR in the pattern antenna of the second pattern in the chip antenna illustrated in FIG. 5, when length of predetermined portions illustrated in FIG. 10 are varied.

Besides, a whole structure of the chip antenna unit according to this embodiment is s a to that of the first embodiment illustrated in FIG. 1. Drawings for the whole structure of the chip antenna unit according to this embodiment are omitted accordingly.

Similarly to the first embodiment, pattern antennas are formed on a plurality of layers of the base member 11. As illustrated in FIG. 5, a pattern antenna A1 (See also FIG. 6) having a first pattern of a meander shape is formed on a first pattern layer 10*a* while a pattern antenna A2' (See also FIG. 7) having a second pattern of a plane shape different from the meander shape of the first pattern is formed on a second pattern layer 10*b*. Besides, the pattern antenna A1 is formed to have the first pattern of meander shape in this embodiment. However, the pattern antenna A1 may be formed to have various patterns of, for example, a circular shape, a rectangular shape, a three-dimensional helical shape over a plurality of layers, and the like.

As illustrated in FIG. 1, a feeding terminal 12 is formed from a bottom surface of the base member 11 to an upper surface thereof through one side surface thereof. Further, fixed terminals 16*a*, 16*b* are formed on two side surfaces opposite to each other and adjacent surfaces around the two side surfaces. Thus, the feeding terminal 12, the fixed terminal 16*a* and the fixed terminal 16*b* are formed on the surfaces of the base member 11, respectively. As depicted in detail in FIG. 5, the feeding terminal 12 is connected to one end of each of the two pattern antennas A1, A2', the fixed terminal 16*a* is connected to another end of the pattern antenna A1, and the fixed terminal 16*b* is connected to another end of the pattern antenna A2', respectively.

Further, also in this embodiment, as illustrated in FIG. 1, the chip antenna 10 is mounted on the mounting substrate 13. Accordingly, it is similar to the first embodiment that a chip antenna unit is constituted by the chip antenna 10 and the mounting substrate 13. A ground electrode 14 is formed on the mounting substrate 13. Further, a feeding path 15 which supplies signals from a signal source (not shown) to the feeding terminal 12 by keeping matching with an impedance of the circuit, for example, 50 Ω is also formed on the mounting substrate 13. Moreover, fixing portions 17*a*, 17*b* which are composed of conductors and connected to the fixed terminals 16*a*, 16*b* and which thereby fix the base member 11 on the mounting substrate 13 are also formed on the mounting substrate 13.

Besides, also in this embodiment, the pattern antennas A1, A2', the feeding terminal 12, the ground electrode 14, the feeding path 15, the fixed terminals 16*a*, 16*b*, and the fixing portions 17*a*, 17*b* are formed by patterning metal conductor layers of copper, silver, and the like. Concrete methods for forming the patterning are similar to those of the first embodiment mentioned before.

In the interim, also in this embodiment, as illustrated in FIG. 5, most portions of the pattern antenna A1 having the first pattern and most portions of the pattern antenna A2' having the second pattern are not overlapping with each other in the stacked direction of a plurality of layers, namely the first pattern layer 10*a*, the second pattern layer 10*b*, and so on. With the structure being illustrated, in the chip antenna 10 of this embodiment, a first resonance F1 (See FIG. 9 described later) can be obtained by the pattern antenna A1. On the other hand, a second resonance F2 (See FIG. 9 described later) can be obtained by the pattern antenna A2'.

Hereunder, referring to FIGS. 10 and 11, description will be made more in detail as regards the second pattern for forming the pattern antenna A2'.

As illustrated in FIG. 10, the pattern antenna A2' includes a first area S1 having a rectangular shape and a second area S2 elongating continuously from the first area S1. Further, a slit T is formed between the first area S1 and the second area S2. Besides, the slit T does not always need to be formed therebetween.

Herein, it is not necessary that the rectangular shape defining the first area S1 is strictly rectangular. For example, a corner or corners of the rectangular shape may be round, respectively. The pattern antenna A2' may include a portion (for example, a portion depicted by netting points in FIG. 10) or portions other than the first area S1 and the second area S2. Besides, in the example illustrated in FIG. 10, the second area S2 is elongating continuously from the first area S1 through the portion depicted by the netting points.

Herein, in FIG. 10, when a length of an arm in the direction that the second area S2 elongates in the first area S1 is defined as L1 and a length of the second area S2 is defined as L2, different resonant waveforms can be obtained in response to a relation or a ratio of L1 and L2. Besides, the resonant waveforms become different also in response to the other elements, such as an area or a width of each area S1, S2, a position of a feeding point, or the like. However, desirable resonant waveforms are obtained in this embodiment by adjusting the above-mentioned relation or the ratio of L1 and L2.

Namely, as illustrated in FIG. 11(*a*), when L1 is larger than L2, the resonant frequency in the first area S1 becomes lower than the resonant frequency in the second area S2. On the other hand, as illustrated in FIG. 11(*b*), when L2 is larger than L1, the resonant frequency in the second area S2 becomes lower than the resonant frequency in the first area S1.

As a result, two resonances can be obtained by thus determining the relation or the ratio of L1 and L2. By the use of such a pattern antenna A2' in a chip antenna, a multi-band wireless communication device capable of being used in a plurality of frequency bands can be obtained only by one pattern antenna (namely, only by the pattern antenna A2' without using the pattern antenna A1).

Further, as illustrated in FIG. 11(*c*), when L1 and L2 are close to each other to have only a little bit difference, resonant points of the two resonances become close to each other. As a result, resonance can be obtained at a broad frequency band. Accordingly, when such a pattern antenna A2' is used in a chip antenna, an wide-band wireless communication device capable of being used at a broad frequency band can be obtained. Besides, a waveform of the second resonance F2 depicted in FIG. 9 is obtained, when L1 and L2 thus become close to each other. As will be understood from FIG. 9, a band of which VSWR is not larger than 2 in the waveform of the second resonance F2 becomes broader, namely, wide-band, compared with a band of which VSWR is not larger than 2 in the waveform of the first resonance F1.

As described above, the pattern antenna A2' includes the first area S1 having the rectangular shape and the second area S2 elongating continuously from the first area S1 in this embodiment. As a result, by adjusting the length L1 of the arm in the direction that the second area S2 elongates in the first area S1 and the length L2 of the second area S2, it becomes possible to obtain resonances in a plurality of frequency bands or a broad frequency band in spite of a plain structure of the chip antenna in this embodiment.

In the above description, two pattern antennas, namely, the pattern antennas A1 and A2' are formed in the chip antenna 10. However, in a case that a frequency band obtained by the pattern antenna A1 is not required, the pattern antenna A1 may be deleted from the chip antenna 10. In this case, the pattern antenna A2' can be formed inside or on any surface of the base member 11. Further, the other pattern antenna having a shape different from the shape of the pattern antenna A2' can be formed in the chip antenna 10 in addition to the pattern antenna A2'. In this case, the other pattern antenna may have various shapes of patterns. Moreover, although only two pattern antennas are formed in this embodiment, three or more pattern antennas can also be formed in the chip antenna of the present invention.

As will be dearly understood from the above description, according to this embodiment of the present invention, it becomes possible to obtain resonances in a plurality f frequency bands or a broad frequency band in spite of a plain structure of the chip antenna by adjusting the length of the arm in the direction that the second area elongates in the first area and the length f the second area.

In addition, also in this embodiment, as illustrated in FIG. 5, most portions of the pattern antenna A1 having the first pattern and most portions of the pattern antenna A2' having the second pattern are not overlapping with each other in the stacked direction. Thus, the structure that the patterns of a plurality of pattern antennas are prevented from being overlapping each other in the stacked direction is employed also in this embodiment. As a result, a meritorious effect similar to that of the first embodiment can also be obtained in this embodiment. Namely, a predetermined pattern antenna can thereby be adjusted to have an optimized resonant frequency without influencing the frequency characteristics of the other pattern antennas.

Further, the resonant frequency of the chip antenna can, of course, be finely tuned by adjusting the areas of the fixing portions, similarly to the first embodiment.

While this invention has thus far been described in specific conjunction with the first and the second embodiments thereof, it will now be readily possible for one skilled in the art to put this invention into effect in various other manners. For example, a chip antenna and a chip antenna unit of the present invention can be used in various wireless communication devices, such as, a portable telephone, a mobile terminal, an included antenna of a wireless LAN card, and the like.

What is claimed is:

1. A chip antenna comprising:

a base member comprising at least one of a dielectric material and a magnetic material and including a stacked structure including a plurality of stacked layers;

a plurality of pattern antennas formed on the plurality of stacked layers and which have predetermined patterns, respectively, and of which at least parts of said predetermined patterns are not overlapping with each other in a stacked direction of the plurality of stacked layers, and a feeding terminal which is formed on a surface of said base member and which is connected to each of the plurality of stacked layers.

2. A wireless communication device in which said chip antenna as claimed in claim 1 is used.

3. A chip antenna as claimed in claim 1, further comprising:

a fixed terminal which is formed on a surface of said base member and which is connected to said plurality of pattern antennas; and a fixing portion comprising a conductor and which is formed on a mounting substrate and which is connected to said fixed terminal and thereby fixes said base member on said mounting substrate.

4. A wireless communication device in which said chip antenna as claimed in claim 3 is used.

5. A chip antenna unit having predetermined frequency characteristics, comprising:

a mounting substrate;

a base member which is mounted on said mounting substrate and comprising at least one of a dielectric material and a magnetic material;

a pattern antenna which is formed on said base member;

a feeding terminal which is formed on a surface of said base member and which is connected to said pattern antenna;

a fixed terminal which is formed on a surface of said base member and which is connected to said pattern antenna;

a fixing portion comprising a conductor and which is formed on said mounting substrate and which is connected to said fixed terminal and thereby fixes said base member on said mounting substrate; and said predetermined frequency characteristics being adjusted by changing an area of said fixing portion.

6. A wireless communication device in which said chip antenna unit as claimed in claim 5 is used.

7. A chip antenna unit having predetermined frequency characteristics, comprising:

a mounting substrate;

a base member which is mounted on said mounting substrate and comprising at least one of a dielectric material and a magnetic material and which has a stacked structure including a plurality of layers;

a plurality of pattern antennas which are formed on said plurality of layers and which have predetermined patterns, respectively, and of which at least parts of said predetermined patterns are not overlapping with each other in a stacked direction of said plurality of layers;

a feeding terminal which is formed on a surface of said base member and which is connected to said pattern antenna;

a fixed terminal which is formed on a surface of said base member and which is connected to said pattern antenna;

a fixing portion comprising a conductor and which is formed on said mounting substrate and which is connected to said fixed terminal and thereby fixes said base member on said mounting substrate; and said predetermined frequency characteristics being adjusted by changing an area of said fixing portion.

8. A wireless communication device in which said chip antenna unit as claimed in claim 7 is used.

9. A chip antenna comprising;

a stacked base member comprising at least one of a dielectric material and a magnetic material and a stacked structure including a plurality of layers;

a pattern antenna which is formed on at least one of the plurality of layers and which includes a first area having a rectangular shape and a second area elongating continuously from said first area;

a slit dividing said first and said second areas of said pattern antenna, said slit elongating straight in a longitudinal direction of the stacked base member; and a feeding terminal which is formed on a surface of said stacked base member and which is connected to said pattern antenna.

10. A chip antenna as claimed in claim 9, wherein a slit is formed between said first and said second areas of said pattern antenna, said chip antenna further comprising:

a fixed terminal which is formed on a surface of said stacked base member and which is connected to said pattern antenna; and a fixing portion comprising a conductor and which is formed on a mounting substrate and which is connected to said fixed terminal and thereby fixes said stacked base member on said mounting substrate.

11. A wireless communication device in which said chip antenna as claimed in claim 10 is used.

12. A chip antenna as claimed in claim 9, wherein said chip antenna further comprises another pattern antenna having a shape other than that of said pattern antenna.

13. A wireless communication device in which said chip antenna as claimed in claim 12 is used.

14. A. wireless communication device in which said chip antenna as claimed in claim 9 is used.

15. A chip antenna comprising:

a base member comprising at least one of a dielectric material and a magnetic material;

a pattern antenna which is formed on said base member and which includes a first area having a rectangular shape and a second area elongating continuously from said first area;

a slit formed between said first and said second areas of said pattern antenna;

a feeding terminal which is formed on a surface of said base member and which is connected to said pattern antenna; and another pattern antenna having a shape other than that of said pattern antenna, wherein said base member comprises a stacked structure including a plurality of layers.

16. A chip antenna comprising:

a base member comprising at least one of a dielectric material and a magnetic material, a pattern antenna formed on said base member;

a fixed terminal which is formed on a surface of said base member and which is connected to said pattern antenna; and a fixing portion comprising a conductor and which is formed on a mounting substrate and which is connected to said fixed terminal and thereby fixes said base member on said mounting substrate, wherein a frequency characteristic of the chip antenna is adjustable by changing an area of said fixing portion.

17. A wireless communication device in which said chip antenna as claimed in claim 16 is used.

18. A chip antenna comprising:

a base member comprising at least one of a dielectric material and a magnetic material, a pattern antenna formed on said base member;

a fixed terminal which is formed on a surface of said base member and which is connected to said pattern antenna; and a fixing portion comprising a conductor and which is formed on a mounting substrate and which is connected to said fixed terminal and thereby fixes said base member on said mounting substrate, wherein said base member comprises a stacked structure including a plurality of layers.

* * * * *